US008047858B2

(12) United States Patent
Jordan

(10) Patent No.: US 8,047,858 B2
(45) Date of Patent: Nov. 1, 2011

(54) ELECTRICAL CONNECTOR

(75) Inventor: Peter Jordan, Basingstoke (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 12/798,807

(22) Filed: Apr. 12, 2010

(65) Prior Publication Data

US 2010/0261387 A1 Oct. 14, 2010

(30) Foreign Application Priority Data

Apr. 14, 2009 (GB) ..... 0906297.7

(51) Int. Cl.
*H01R 13/44* (2006.01)

(52) U.S. Cl. ..... 439/131; 439/578

(58) Field of Classification Search ..... 439/131, 439/578

See application file for complete search history.

(56) References Cited

U.S. PATENT DOCUMENTS 4,963,105 A * 10/1990 Lewis et al. ..... 439/578
5,310,359 A * 5/1994 Chadbourne et al. ..... 439/462
5,316,495 A * 5/1994 Frantz ..... 439/372
5,366,315 A * 11/1994 Hartley ..... 403/326
5,921,799 A 7/1999 Forrester
5,984,706 A 11/1999 Kakuta et al.
6,464,526 B1 10/2002 Seufert et al.
6,632,102 B1 * 10/2003 Gherardini ..... 439/352
6,733,336 B1 5/2004 Montena et al.
7,131,852 B1 * 11/2006 Chen ..... 439/131
7,301,596 B1 11/2007 Morganstern et al.
7,758,389 B2 * 7/2010 Kadar-Kallen et al. ..... 439/660
7,787,243 B2 * 8/2010 Salazar et al. ..... 361/679.31
2008/0299814 A1 12/2008 Rioufreyt et al.

FOREIGN PATENT DOCUMENTS

EP 0285703 A2 12/1988
JP 2004319313 11/2004

* cited by examiner

*Primary Examiner* — Truc Nguyen
(74) *Attorney, Agent, or Firm* — Peter Van Winkle

(57) ABSTRACT

An electrical connector comprises a dielectric spacing element having elongate through holes and a forward end surface; a plurality of parallel, elongate conductive contacts arranged in respective through holes of the spacing element, the conductive contacts providing electrical connections; an outer body arranged about the spacing element and the conductive contacts, the outer body having a longitudinal position fixed relative to the dielectric spacing element and having a forward end for engagement with a mating connector; and a collar slidably mounted about the outer body. The collar has an engagement position in which a forward surface of the collar is positioned in front of the forward end of the outer body for mechanically coupling the connector with the mating connector and a retracted position in which the forward surface of the collar is positioned behind the forward end surface of the spacing element for cleaning access to the conductive contacts. The connector further comprises means, such as a resilient member, for maintaining the collar in the retracted position.

5 Claims, 3 Drawing Sheets

ELECTRICAL CONNECTOR

CROSS-REFERENCE

Applicant claims priority from Great Britain patent application GB 0906297.7 filed 14 Apr. 2009.

FIELD OF THE INVENTION

This invention relates to an electrical connector which is suitable for use in dirty, dusty or other extreme environments. More particularly, though not exclusively, the invention relates to such an electrical connector for use in carrying data signals and for which there is a need for in-field cleaning.

BACKGROUND OF THE INVENTION

There is frequently a need for electrical equipment to be used in dirty, dusty or other extreme environments. Although the provision of exposed electrical connectors in equipment intended for such environments can sometimes be effectively minimized, in many applications exposed connectors are essential for providing desired functionality.

An example of electrical equipment which is designed to be suitable for use in extreme conditions is military equipment carried by infantry personnel. Such equipment includes radio communications devices and navigation and vision enhancement systems. Increasingly this equipment is connected to a computer pack which includes a microprocessor for coordinating interoperability of the equipment.

There is a requirement for the equipment carried by infantry personnel to be provided with exposed electrical connectors, that is to say connectors on the outside of sealed equipment enclosures. In particular, the equipment typically has a modular design so that different personnel can carry different items of equipment. It is important that items of equipment which are not required by an individual can be detached from the rest of the equipment so as to minimize carried weight. Furthermore, the provision of exposed electrical connectors is desirable as it facilitates the substitution of items of equipment for repairs and routine servicing.

A significant problem in the design of an electrical connector for use with such military equipment is the need to maintain reliable electrical connections in dirty, dusty or other extreme environments. This problem is particularly challenging where, as is typically the case, the connector is used for carrying low voltage data signals which tend to be highly sensitive and susceptible to degradation caused by environmental conditions.

There is also a general desire for such electrical connectors to be "breakaway" connectors, that is to say capable of disengaging in response to an axial disengaging force. Such connectors help to prevent damage to equipment and/or personal injury when electrical cables are accidentally snagged. The provision of "break-away" functionality, however, exacerbates the above-described problem because clamping mechanisms and the like cannot be used.

SUMMARY OF THE INVENTION

In making the invention, the inventor has recognized that the above-mentioned problem of maintaining reliable electrical connections can be addressed by including provision for in-field cleaning of the connector.

Accordingly, the invention provides an electrical connector comprising:

a dielectric spacing element provided with a number of elongate through holes and a forward end surface;

a number of parallel, elongate conductive contacts arranged in respective through holes of the spacing element, the conductive contacts providing electrical connections;

an outer body arranged about the spacing element and the conductive contacts, the outer body having a longitudinal position fixed relative to the dielectric spacing element and having a forward end for engagement with a mating connector; and a collar slidably mounted about the outer body, the collar having an engagement position in which a forward surface of the collar is positioned in front of the forward end of the outer body for mechanically coupling the connector with the mating connector and having a retracted position in which the forward surface of the collar is positioned behind the forward end surface of the spacing element for cleaning access to the conductive contacts, wherein the connector further comprises means for maintaining the collar in the retracted position.

The forward surface of the collar may also be positioned in front of the forward end surface of the spacing element when in the engagement position. Further, the forward surface of the collar may be positioned behind the forward end of the outer body when in the retracted position.

It is known to provide collars for mechanically coupling electrical connectors with mating connectors. However, by providing a collar which can be retracted behind a forward end surface of the spacing element, and by providing means for maintaining the collar in the retracted position, the connector can be more easily maintained in a clean condition. With the collar moved forwards into the engagement position, the conductive contacts of the connector are at least partially protected from the environment.

The electrical connector is preferably a "break-away" connector, so that when mated to another connector the connectors will disengage under an axial disengaging force.

The means for maintaining the collar in the retracted position for cleaning may comprise a locking mechanism for locking the collar in the retracted position. However, it is preferred that the means simply serves to resist movement of the collar away from the retracted position, optionally to a greater degree than from other intermediate longitudinal positions of the collar. In embodiments, a longitudinal force on the collar of at least 2N, preferably 5N, and more preferably 10N, is required to release the collar from the retracted position.

For example, the means for maintaining the collar in the retracted position may comprise a first resilient member deformable in the transverse direction. The first resilient member may be arranged, in the retracted position of the collar, to resist sliding longitudinal movement of the collar. The first resilient member may be arranged between the outer body and the collar and may be maintained in a circumferential channel or groove formed in one of an outer surface of the outer body and an inner surface of the collar.

The first resilient member may be arranged, in the retracted position of the collar, to sit in a recess formed in the other of the outer surface of the outer body and the inner surface of the collar (which faces the circumferential channel or groove). The force required to longitudinally slide the collar along the outer body may be adjusted by adjusting the profile of the surface of the outer body or collar facing the circumferential channel or groove.

The first resilient member is preferably a coil spring extending about the connector axis. In this application the coil spring is resiliently loaded in the transverse direction of the spring (and the connector). The coil spring may be formed of a beryllium copper alloy. The coil spring may have a non-circular shape, with the major dimension being in the longitudinal direction of the connector.

In a preferred embodiment, the electrical connector further comprises a second resilient member arranged between the outer body and the collar when in the retracted position. The second resilient member may be similar in design to the first resilient member and may be maintained in a circumferential channel formed in the inner surface of the collar. The second resilient member may be positioned near the forward surface of the collar such that with the collar in the engagement position the second resilient member is positioned in front of the forward end of outer body for engagement with the mating connector.

The design of the outer body, the collar and the first and second resilient members may be adapted so that the longitudinal force required for releasing the collar from the engagement position (when unmated) is greater than the longitudinal force required for releasing the collar from the retracted position. This reflects the fact that the engagement position is the normal in-field position for the collar, with the collar only being retracted only for occasional cleaning access to the conductive contacts.

The design of the outer body, the collar and the first and second resilient members may also be adapted such that the longitudinal force required for releasing the collar from the engagement position (when unmated) is greater than the longitudinal force required for engaging the connector with the mating connector. In this way, accidental retraction of the collar while engaging the connector with a mating connector can be avoided.

In embodiments, the outer body comprises a tubular wall, and the forward end of the outer body comprises longitudinally protruding formations, such as castellations, in the tubular wall. The longitudinally protruding formations serve as a keying arrangement for fixing the angular position of the connector with respect to the mating connector (an outer body of the mating connector being provided with corresponding formations). Additionally, the openings between the protruding formations may provide enhanced cleaning access to the conductive contacts of the connector.

For such embodiments, references herein to longitudinal positions in front of the forward end of the outer body refer to positions in front of the forward tips of the protruding formations and references herein to longitudinal positions behind the forward end of the outer body refer to positions behind the rearward-most extending space between the protruding formations.

In embodiments, the spacing element is formed of a resilient impermeable material, such as a resilient plastics material, for preventing the ingress of dirt into the through holes formed therein. Particularly suitable materials for the spacing element include fluorosilicone rubber materials. In connectors having a resilient spacing element, a second more rigid spacing element may be positioned in the connector behind the resilient spacing element. The second spacing element has through holes in positions corresponding to the through holes of the spacing element formed of the resilient material and serves to more accurately maintain the transverse positions of the conductive contacts.

In embodiments, forward ends of the conductive contacts are exposed in front of the end of the spacing element. In this way, the contacts can be easily cleaned with the collar in the retracted position.

The conductive contacts may be so-called "pogo contacts". In this case, each contact comprises rearward and forward contact elements, wherein the forward contact element is longitudinally slidable relative to the rearward contact element against a spring element. In this way, a reliable electrical connection may be formed when the forward contact element is biased by the fixed contact of a mating connector.

The invention also provides a shielded electrical connector comprising the electrical connector described above, wherein the outer body is formed of a conductive material for shielding the conductive contacts. An inner ferrule and rear body may also be provided for terminating the outer braid of a shielded electrical cable.

The invention also provides an electrical cable arrangement comprising a cable terminated with the electrical connector described above.

Another aspect of the invention provides an electrical connector pair comprising:

a first electrical connector as described above; and a second electrical connector mated to the first electrical connector, the second connector comprising an outer body having a forward end for engagement with the first connector.

Other features and advantages of the invention will become apparent from the detailed description which follows.

The novel features of the invention are set forth with particularity in the appended claims. The invention will be best understood from the following description when read in conjunction with the accompanying drawings.

DESCRIPTION OF THE DRAWINGS

An embodiment of the invention will now be described, by way of example only, with reference to the accompanying drawings in which:

FIG. 1A is an enlarged view of a portion of FIG. 1 showing a first retention member 11 in a mating position, and showing, in phantom lines, a mating connector apparatus being held by a second retention member 13.

DESCRIPTION OF THE INVENTION

1. Limited Description of the Invention

Figure 1:
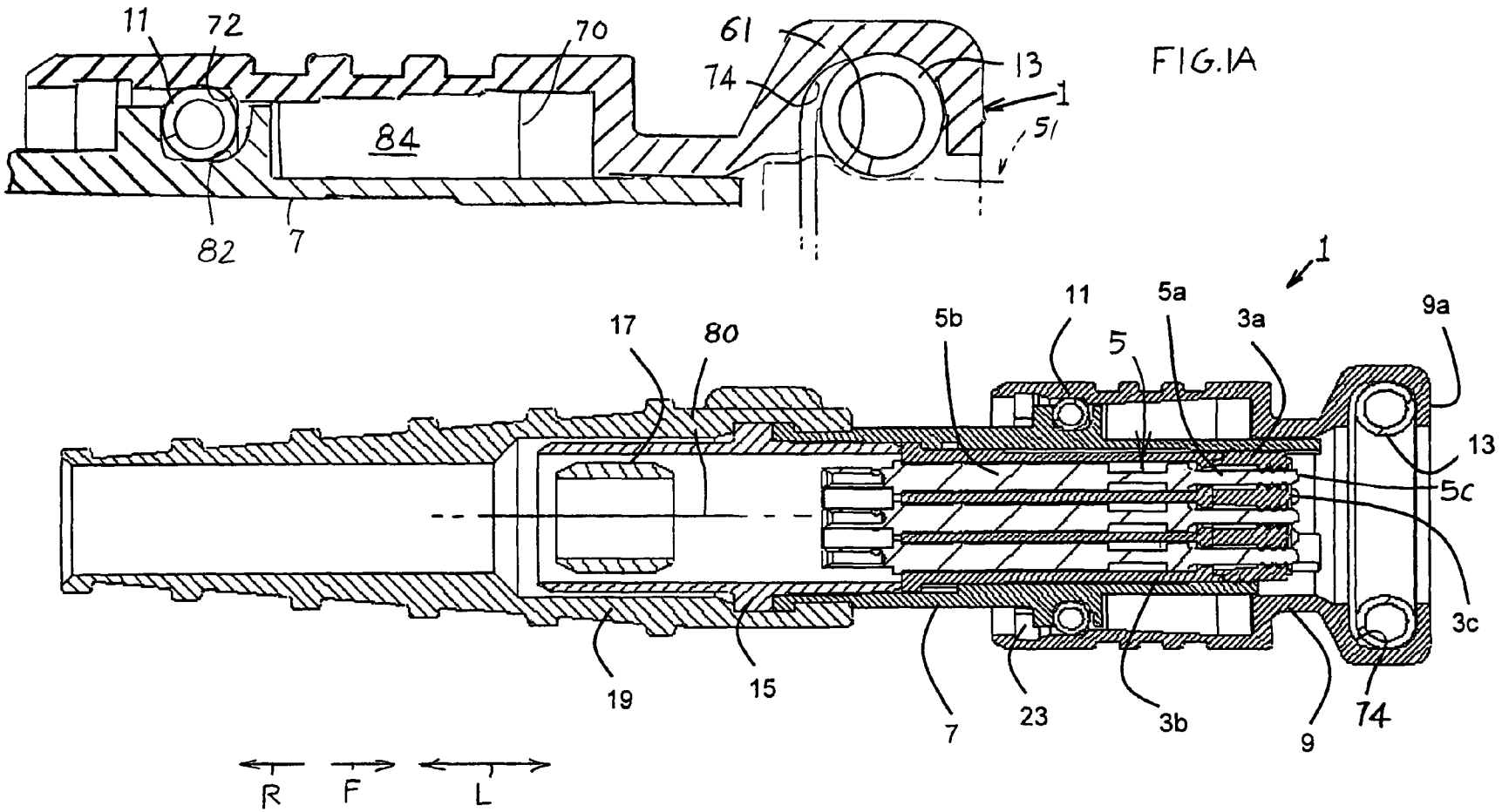
FIG. 1 is a cross-sectional view of an electrical connector according to the invention.

FIG. 1 shows a connector 1 which includes an outer body 7 that holds dielectric contact-holding components or spacers such as 3*a* and 3*b* which, in turn, hold electrical contacts 5. The body has an axis 80 that extends longitudinally L in forward and rearward directions F, R. The contacts have front ends 5*c* which engage contacts of a mating connector apparatus (51 in FIG. 5). A cable receptacle 19 at the rear of the outer body 7 and at a metal rear body 15, hold an electrical cable whose wires are connected to the electrical contacts 5.

Figure 3:
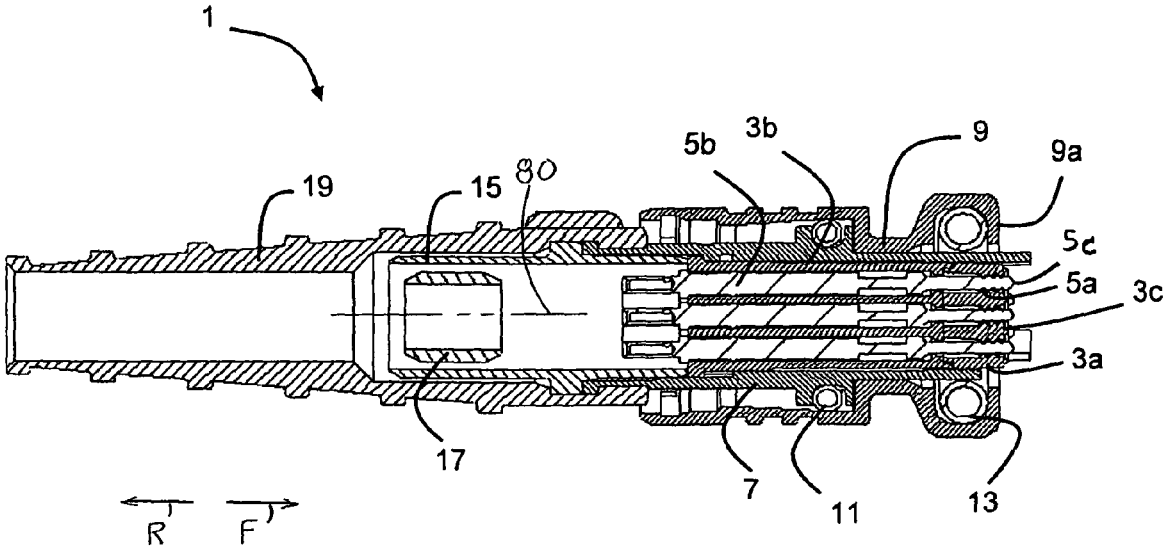
FIG. 3 is a cross sectional view of the electrical connector shown in FIG. 1 moved into a configuration for cleaning.

A collar 9 (FIG. 1) is slidably mounted on the front end of the outer body to slide between front and rear positions. In FIG. 1 the collar lies in a forward position wherein the collar protects the front ends of the contacts 5. In FIG. 3 the collar has been moved to its rearward position at which it exposes the front ends 5*c* of the contacts to facilitate cleaning them. In FIG. 3 the contact front ends 5*c* lie at least as far forward as the front end of the collar.

When the collar has been moved forwardly F along the axis to the forward position of FIG. 1, the collar is retained in that position by a retention member 11. The retention member has locations spaced about its loop-like shape that are resiliently deflectable radially (towards or away from the axis 80). The particular retention member is in the form of a coil, or helically-wound wire spring that has been bent into a circular loop. The retention member lies in a groove 82 (FIG. 1A) that is formed in the outer body 7 and that extends around the axis. The collar forms a space 84 between it and the outer body along which the retention member can slide forward and rearward. The longitudinally-extending space 84 forms a primarily rearwardly-facing shoulder 72 on the collar that resists forward movement of the retention member (and rearward movement of the collar), and therefore resists movement of the contact-holding component or spacers 3*a*, away from the position suitable for mating to the another connector apparatus.

To move the collar 9 rearward from the collar forward position shown in FIG. 1, for cleaning of the contacts, takes considerable force to push the retention member 11 forward over the shoulder 72. This assures that the connector will remain in position for mating. When the collar has been moved to its rearward position (FIG. 3) for cleaning of contacts, the collar tends to remain in that position, but it does not take as much force to return the collar from its rearward position to its forward position. Although a rearward-facing shoulder could be placed at 70 in FIG. 1A, applicant finds this is usually not necessary, as applicant can depend on friction of the retention member to hold it and the collar in place during cleaning.

Figure 4:
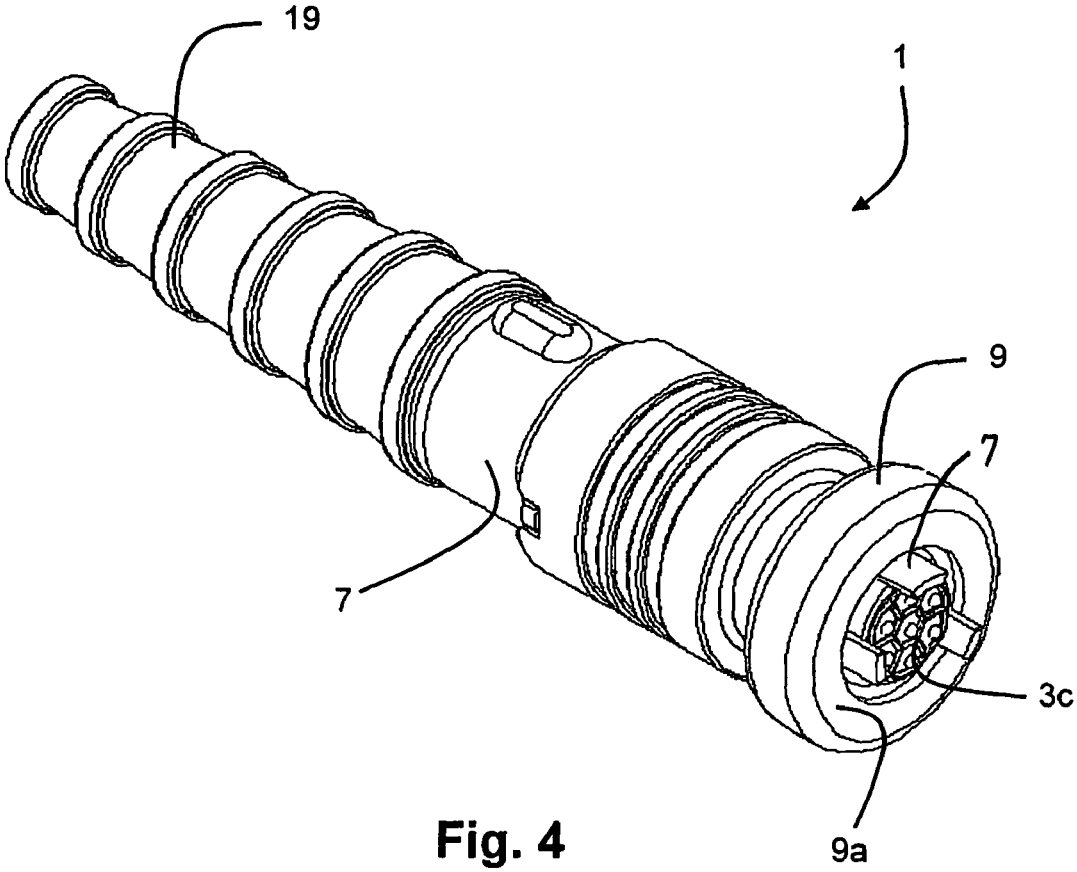
FIG. 4 is a perspective view of the electrical connector shown in FIG. 1 in the configuration for cleaning.

FIG. 1 shows that the connector has a second retention member 13 that lies in a groove 74 at the front end of the collar 9. The purpose of the second retention member 13 is to latch the connector 1 to a mating connector apparatus such as is shown at 51 in FIG. 5. The connector apparatus 51 has an interrupted tubular body 59 that can be inserted into spaces between the tubular outer body 7 (FIG. 4). The connector apparatus is inserted until walls forming a groove 61 of the connector apparatus enters the collar of the connector. FIG. 1A shows walls of the groove 61 lying within the second retention member 13, and with the two connectors 1, 51 fully mated.

2. Detailed Description of the Invention

The invention provides an electrical connector comprising a dielectric spacing element provided with a number of elongate through holes and a number of parallel, elongate conductive contacts arranged in respective through holes of the spacing element, the conductive contacts providing electrical connections. The connector also comprises an outer body arranged about the spacing element and the conductive contacts, the outer body having a longitudinal position fixed relative to the dielectric spacing element and having a forward end for engagement with a mating connector. The connector is provided with a collar slidably mounted about the outer body and having an engagement position and a retracted position. In the engagement position, a forward surface of the collar is positioned in front of the forward end of the outer body for mechanically coupling the connector with the mating connector. In the retracted position, the forward surface of the collar is positioned behind a forward end surface of the spacing element for cleaning access to the conductive contacts. According to the invention, the connector further comprises means for maintaining the collar in the retracted position.

With reference to FIGS. 1 to 4, an electrical connector according to the invention is a shielded connector 1 comprising a dielectric spacing element 3*a*, 3*b*, a plurality of parallel elongate conductive contacts 5*a*, 5*b* arranged in longitudinal through holes of the spacing element, an outer body 7 arranged about the spacing element and a collar 9 slidably arranged about the outer body.

The conductive contacts 5*a*, 5*b* are so called "pogo contacts" comprising longitudinally slidable forward contact elements 5*a* which are spring-mounted against rearward contact elements 5*b* having fixed longitudinal positions. In this way, the forward contact elements 5*a* can be displaced rearwards when loaded, for example by the respective contacts of a mating connector (not shown). The conductive contacts 5*a*, 5*b* are formed of a copper alloy and are gold-plated.

The conductive contacts 5*a*, 5*b* are maintained in spaced apart positions and parallel orientation by the generally cylindrical-shaped dielectric spacing element 3*a*, 3*b*. The spacing element 3*a*, 3*b* also fixes the longitudinal positions of the reward contact elements 5*b*. The spacing element includes a shallow forward spacing element 3*a* and a deeper rearward spacing element 3*b*, each of which are provided with the longitudinal through holes for accommodating the conductive contacts 5*a*, 5*b*.

The forward spacing element 3*a* is provided with a substantially flat forward end surface 3*c* through which the tips of the forward contact elements 5*a* project slightly in their undisplaced position to facilitate cleaning.

The forward spacing element 3*a* is formed of a fluorosilicone rubber material and serves primarily to form a seal between the forward contact elements 5*a* and the outer body 7 of the connector 1 for preventing the ingress of dirt, dust and moisture, etc. The rearward spacing element 3*b* is formed of a rigid plastics material and serves primarily to accurately maintain the transverse positions of the conductive contacts 5*a*, 5*b*, even under transverse loads.

The outer body 7 of the connector 1 is arranged about the spacing element 3*a*, 3*b* and is generally tubular in form. The longitudinal position of the outer body 7 is fixed relative to the spacing element 3*a*, 3*b* and serves to electrically shield the conductive contacts 5*a*, 5*b*, as well as functioning to mechanically engage with the mating connector.

A forward end of the outer body 7 is provided with projection which key with spaces between corresponding recesses formed in an outer body of the mating connector to ensure that the connectors are mated in their correct angular orientations. The outer body 7 is formed of stainless steel to provide sufficient strength for the keying arrangement. The castellations in the outer body 7 also partially expose the side of the spacing element 3*a*, 3*b*, with the forward end surface 3*c* of the forward spacing element 3*a* being positioned midway along the length of the castellations.

An outer surface of the outer body 7 is provided with a circumferential channel for accommodating a resilient member 11, as described below.

A rearward end of the outer body 7 is provided with a transverse flange for engaging a metal rear body 15 of the connector 1. The rear body 15 and a metal inner ferrule 17 are adapted for terminating the braid of a shielded electrical cable (not shown) in a known manner. The rearward end of the outer body 7 and the rear body 15 are also provided with a cable receptacle 19 for providing cable strain relief, which cable receptacle 19 may be overmolded in a plastics material.

The collar 9 (FIG. 2), which is also generally tubular in form, is arranged about the outer body 7 to be longitudinally slidable. An inner surface of the collar 9 is provided with a protrusion (not shown) extending radially inwardly. The protrusion travels in a longitudinal channel 21 formed in the outer surface of the outer body 7 and prevents the collar 9 from rotating about the outer body 7, which rotation might otherwise lead to premature wear of the connector's components. The collar 9 is formed of a high tensile aluminum alloy. The inner surface of the collar 9 is provided towards its forward end with a transverse flange. The transverse flange is arranged to limit the rearward longitudinal travel of the collar 9 by abutting with a transverse flange formed in the outer body 7. Forward longitudinal travel of the collar 9 is limited by abutment of a "C" shaped retaining clip 23 coupled to a rearward end of the collar 9 with another transverse flange formed in the outer body 7.

The forward-most position of the collar 9 is an engagement position in which the connector 1 can be mechanically coupled to the mating connector. The rearward-most position of the collar 9 is a retracted position (FIG. 3) in which the forward contact elements 5*a* of the connector can be easily accessed for cleaning.

As described above, the outer surface of the outer body 7 is provided with a circumferential channel which accommodates a resilient member 11. The resilient member 11 is an elongate, tightly wound coil spring formed of beryllium copper which extends around the length of the circumferential channel. The coil spring has a non-circular cross-section, with the major dimension extending in the longitudinal direction of the connector 1.

The coil spring resiliently bears against the inner surface of the collar 9 in a transverse direction of both the spring and the connector. The collar 9 is adapted to be maintained in its engagement and retracted positions by appropriately varying the diameter of the inner surface of the collar 9 against which the coil spring bears. In the embodiment shown, in the engagement and retracted positions of the collar 9, the portions of the inner surface of the collar 9 facing the coil spring have slightly enlarged diameters (which define recesses). The collar 9 then resists being moved away from the engagement and retracted positions since to do so would require a force to be applied sufficient to compress the coil spring as the collar 9 slides longitudinally over the spring.

The outer body 7, collar 9 and coil spring are arranged such that the longitudinal force required for releasing the collar 9 from its engagement position (while unmated) is greater than the longitudinal force required for releasing the collar 9 from its retracted position.

The inner surface of the collar 9 is provided at its forward end with another resilient member 13 similar to that described above but having greater transverse dimensions. The resilient member 13 is maintained in a channel formed in the inner surface of the collar 9 and serves to mechanically couple the connector 1 to the mating connector.

In the engagement position of the collar 9, a forward end surface 9*a* of the collar 9, together with the resilient member 13, extend in front of both the forward surface 3*c* of the spacing element 3*a*, 3*b* and the forward end of the outer body 7. In the retracted position of the collar 9, the forward end surface 9*a* of the collar 9 is positioned behind both the forward surface 3*c* of the spacing element 3*a*, 3*b* and the forward end of the outer body 7 to facilitate cleaning of the conductive contacts 5*a*, 5*b*, as described above. In the drawings, FIGS. 1 and 2 show the connector 1 with the collar 9 in the engagement position and FIGS. 3 and 4 show the connector 1 with the collar 9 in the retracted position.

Figure 5:
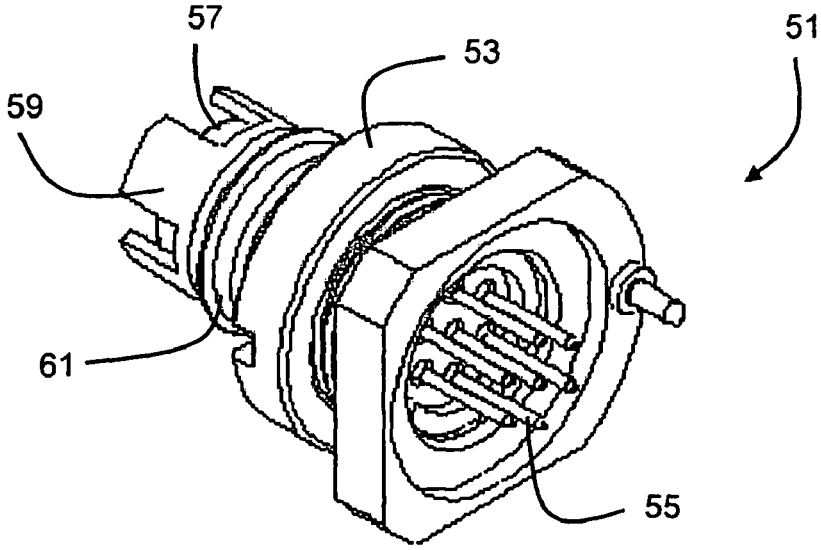
FIG. 5 is a perspective view of another electrical connector for mating with the electrical connector shown in FIG. 1.

FIG. 5 shows another connector 51 suitable for mating with the connector shown in FIGS. 1 to 4. The mating connector 51 is a flanged connector suitable for mounting in the wall of an electrical equipment enclosure and a lock nut 53 is provided for this purpose. As well as a plurality of fixed longitudinal contacts 55 and a spacing element 57, the mating connector 51 comprises a generally tubular outer body 59. A forward end of the outer body 59 is provided with castellations (projections) corresponding to the spaces between the castellations provided in the outer body 7 of the connector 1 described above.

The outer surface of the outer body 59 of the mating connector 51 is provided with a circumferential groove 61. The circumferential groove 61 is arranged to engage the resilient member 13 provided in the forward end of the collar 9 of the connector 1 described above for mechanically coupling the connectors 1, 51.

Figure 2:
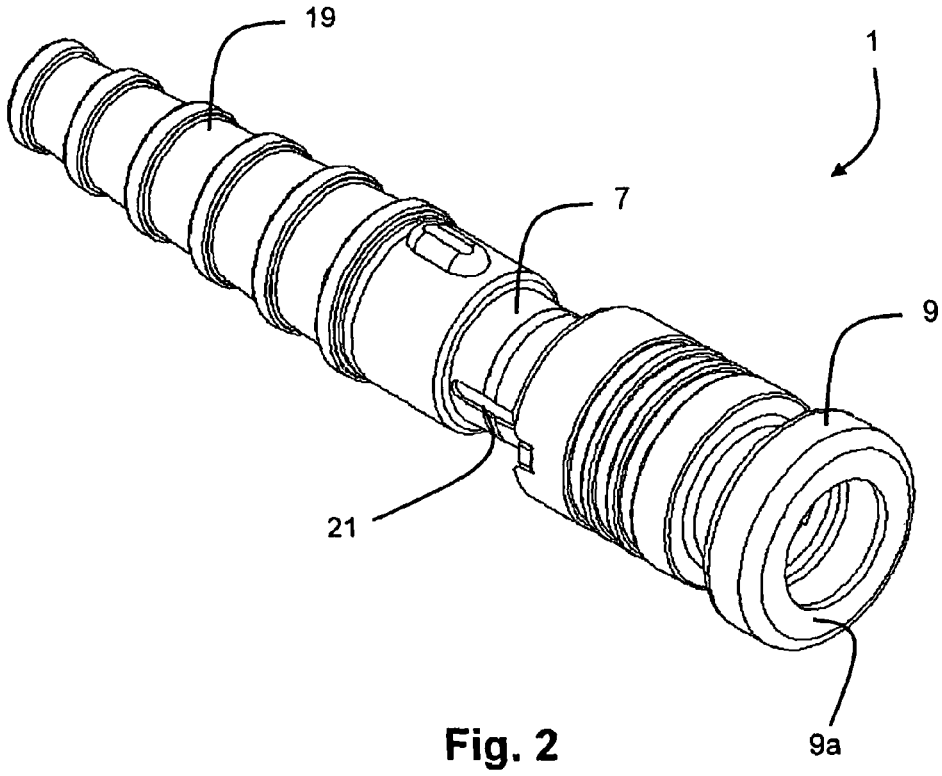
FIG. 2 is a perspective view of the electrical connector shown in FIG. 1.

In normal use of the connectors 1, 51, the collar 9 of the connector 1 is maintained in the engagement position, as shown in FIGS. 1 and 2. In this configuration, the connector 1 can be positively coupled to the mating connector 51 by axially pushing the outer bodies 7, 59 of the connectors 1, 51, correctly keyed, towards each other. In this way, the resilient member 13 slides over the outer body 59 of the mating connector 51 and is received into the circumferential groove 61. The resilient member 13 maintains the coupled condition of the connectors 1, 51.

The components of the connector 1 are arranged such that the longitudinal (front-rear) force required for releasing the collar 9 from its engagement position is greater than the longitudinal force required for engaging the connector 1 with the mating connector 51. In this way, unintentional retraction of the collar 9 can be avoided.

The connectors 1, 51 can also be uncoupled by axially pulling the outer bodies 7, 59 of the connectors apart. With the collar 9 in the engagement position (FIG. 1) the conductive contacts 5*a*, 5*b* are protected against physical damage or accidental shorting.

When it is desired to clean the conductive contacts 5*a*, 5*b* of the connector 1, for example when dirt has traveled down the collar 9, a longitudinal force L can be applied to the collar 9 to release the collar 9 from its engagement position. The collar 9 can then be moved rearwards into its retracted position, in which position the collar 9 is maintained by the resilient member 11. In the retracted position of the collar 9, the conductive contacts 5*a*, 5*b* can be easily physically accessed for cleaning, for example with a wiping cloth. By resisting movement of the collar 9 away from the retracted position, the resilient member 11 ensures that cleaning of the conductive contacts 5*a*, 5*b* is effective, even under difficult conditions in which the user might not be able to devote their full attention to the task.

After the conductive contacts 5*a*, 5*b* have been cleaned, a longitudinal force can be applied to the collar 9 to release it from its retracted position and return it to its engagement position ready for normal use of the connector 1.

The conductive contacts 5*a*, 5*b* of the mating connector 51 are accessible for cleaning in their normal configuration, as shown in FIG. 5.

A specific, non-limiting embodiment of the invention has been described above. Various changes may be made without departing from the invention, the scope of which is defined by the claims.

For example, the connector described above is a connector for terminating a cable. The connector may, however, be a flanged connector for mounting in the wall of an enclosure.

The outer housing and/or collar of the connector may be provided with colored bands for aiding identification.

The collar of the connector described above is provided with a second, forward resilient member for mechanically coupling the connector with the mating connector. However, other mechanical coupling means may be provided such as threaded and bayonet couplings.

In the connector described above, the first, rearward resilient member is a coil spring. However, other resilient members such as leaf springs and rubber "O" rings may be used.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector which includes an outer body (7) having an axis (80), a dielectric contact-holding component (3*a*, 3*b*) lying in said body, and a plurality of contact elements (5) lying in said dielectric contact-holding component, said contact elements having front ends (5*c*), wherein:

said electrical connector includes a collar (9) that is slidable longitudinally between forward and rearward positions on said body, wherein in said rearward position said contact element front ends (5*c*) are easily accessible for cleaning, and wherein in said forward position said contact element front ends are protected and not easily accessible;

said collar (9) has a rearward-facing shoulder (72) and said outer body (7) has a groove (82) that extends in a direction around said axis (80), and including a first retention member (11) in the form of a metal coil spring that engages said shoulder as said collar slides away from said collar forward position and toward said collar rearward position;

in said collar forward position said shoulder (72) lies adjacent to said retention member and said shoulder faces primarily rearward, to strongly resist the beginning of rearward sliding of the collar.

2. An electrical connector pair which comprises a first electrical connector that includes an outer body (7) having an axis (80), a dielectric contact-holding component (3*a*, 3*b*) lying in said body, and a plurality of contact elements (5) lying in said dielectric contact-holding component, said contact elements having front ends (5*c*), wherein:

said first electrical connector includes a collar (9) that is slidable longitudinally between forward and rearward positions on said body, wherein in said rearward position said contact element front ends (5*c*) are easily accessible for cleaning, and wherein in said forward position said contact element front ends are protected and not easily accessible;

of said outer body (7) and said collar (9), one of them has a rearward-facing shoulder (72) and the other has a first retention member (11) that engages said shoulder as said collar slides to said rearward position to retain said collar in said rearward position;

said electrical connector pair includes a mating connector apparatus (51) that is mateable to said connector, and wherein;

said collar has an internal groove (74) that extends around said axis, and including a second retention member (13) lying in said groove with said second retention element being resiliently radially deflectable;

said mating connector apparatus having a rear portion that is insertable into said outer body front end and that radially deflects said retention element to latch said mating connector apparatus to said connector.

3. An electrical connector which includes an outer body (7) having front and rear ends and having an axis (80) extending in front and rear directions, a dielectric contact-receiving component (3*a*, 3*b*) lying in said body, and a plurality of contact elements (5) lying in said contact-receiving component, said connector also including a mating connector apparatus (51) that is mateable to said connector, wherein:

said connector includes a collar (9) at the front end of said outer body, said collar having an internal groove (74) that extends around said axis, and including a retention element (13) lying in said groove with said retention element being resiliently radially deflectable;

said mating connector apparatus (51) having a rear portion that forms a groove (61) and that is insertable into said outer body front end and that radially deflects said retention element to latch said mating connector apparatus to said connector;

said collar (9) is slidable longitudinally between forward and rearward positions on said body, wherein in said rearward position said contact element front ends (3*c*) are easily accessible for cleaning, and wherein in said forward position said contact element front ends are protected;

of said outer body (7) and said collar (9), one of them has a shoulder (72) that faces at least partially in said axial direction and the other has a first retention member that engages said shoulder as said collar slides to said rearward position to retain said collar in said forward position.

4. An electrical connector comprising:

a dielectric spacing element provided with a number of elongate through holes and a forward end surface;

a number of parallel, elongate conductive contacts arranged in respective through holes of the spacing element, the conductive contacts providing electrical connections;

an outer body that has an axis and that is arranged about the spacing element and the conductive contacts, the outer body having a longitudinal position fixed relative to the dielectric spacing element and having a forward end for engagement with a mating connector; and a collar slidably mounted along said axis about the outer body, the collar having an engagement position in which a forward surface of the collar is positioned in front of the forward end of the outer body for mechanically coupling the connector with the mating connector and having a retracted position in which the forward surface of the collar is positioned behind the forward end surface of the spacing element for cleaning access to the conductive contacts, wherein the connector further comprises means for maintaining the collar in the retracted position which comprises a first resilient member deformable in the transverse direction that is perpendicular to said axis, the first resilient member being arranged in the retracted position of the collar to resist sliding longitudinal movement of the collar; and comprising a second resilient member arranged between the outer body and the collar in the retracted position, the second resilient member being maintained in a circumferential channel formed in the inner surface of the collar, such that with the collar in the engagement position the second resilient member is positioned in front of the forward end of outer body for engagement with the mating connector.

5. An electrical connector comprising:

a first dielectric spacing element provided with a number of elongate through holes and a forward end surface;

a number of parallel, elongate conductive contacts arranged in respective through holes of the first spacing element, the conductive contacts providing electrical connections;

an outer body that has an axis and that is arranged about the first spacing element and the conductive contacts, the outer body having a longitudinal position fixed relative to the first dielectric spacing element and having a forward end for engagement with a mating connector;

a collar slidably mounted along said axis about the outer body, the collar having an engagement position in which a forward surface of the collar is positioned in front of the forward end of the outer body for mechanically coupling the connector with the mating connector and having a retracted position in which the forward surface of the collar is positioned behind the forward end surface of the first spacing element for cleaning access to the conductive contacts, wherein the connector further comprises means for maintaining the collar in the retracted position; and a second spacing element positioned behind the first spacing element, the second spacing element having through holes in positions corresponding to the through holes of the first spacing element for maintaining the transverse positions of the conductive contacts.

* * * * *